US009279430B2

(12) United States Patent
Chaffee

(10) Patent No.: US 9,279,430 B2
(45) **Date of Patent: *Mar. 8, 2016**

(54) PUMP WITH AXIAL CONDUIT

(71) Applicant: Robert B. Chaffee, Portland, ME (US)

(72) Inventor: Robert B. Chaffee, Portland, ME (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/332,114

(22) Filed: Jul. 15, 2014

(65) Prior Publication Data

US 2015/0044078 A1 Feb. 12, 2015

Related U.S. Application Data

(63) Continuation of application No. 13/205,271, filed on Aug. 8, 2011, now Pat. No. 8,776,293, which is a continuation of application No. 11/339,025, filed on Jan. 25, 2006, now Pat. No. 8,016,572, which is a continuation of application No. 10/113,836, filed on Apr. 1, 2002, now Pat. No. 7,025,576, which is a continuation-in-part of application No. 09/859,706, filed on May 17, 2001, now Pat. No. 7,039,972, and a continuation-in-part of application No. PCT/US01/15834, filed on May 17, 2001.

(60) Provisional application No. 60/280,040, filed on Mar. 30, 2001, provisional application No. 60/204,836, filed on May 17, 2000, provisional application No. 60/280,257, filed on Mar. 30, 2001.

(51) Int. Cl.

| | |
|---|---|
| ***F04B 17/03*** | (2006.01) |
| ***F04D 29/54*** | (2006.01) |
| ***A47C 27/08*** | (2006.01) |
| ***F04D 25/06*** | (2006.01) |
| ***F04D 17/16*** | (2006.01) |
| ***F04D 29/44*** | (2006.01) |

(52) U.S. Cl.

CPC ..... *F04D 29/542* (2013.01); *A47C 27/082* (2013.01); *F04D 17/165* (2013.01); *F04D 25/06* (2013.01); *F04D 29/444* (2013.01)

(58) Field of Classification Search

CPC ..... F04D 29/542; F04D 25/06; F04D 13/12; F04D 3/00; A47C 27/082

See application file for complete search history.

(56) References Cited

U.S. PATENT DOCUMENTS

| | | | |
|---|---|---|---|
| 388,037 | A | 8/1888 | Hargin |
| 625,114 | A | 5/1899 | MacSpadden |

(Continued)

FOREIGN PATENT DOCUMENTS

| | | | |
|---|---|---|---|
| CN | 2037006 | U | 5/1989 |
| CN | 1274266 | A | 11/2000 |

(Continued)

OTHER PUBLICATIONS

Image of Aero product—inflatable bed; Approx. 2002.

(Continued)

*Primary Examiner* — Charles Freay
(74) *Attorney, Agent, or Firm* — Lando & Anastasi, LLP

(57) ABSTRACT

In one aspect, a pump for moving air includes an inlet, an outlet, an outer housing adapted to couple to an inflatable device, and an inner housing located within the outer housing, an electromechanically-controlled valve assembly, and electrical switches. An air conduit is defined between the inner housing and the outer housing. A motor is at least partly positioned within the inner housing, and a plurality of vanes is positioned within the air conduit. The pump can be connected to an inflatable device bladder via a socket.

20 Claims, 7 Drawing Sheets

(56) References Cited

U.S. PATENT DOCUMENTS 633,968 A 9/1899 Swartzwelder
679,519 A 7/1901 Smith
827,823 A 8/1906 Starr
847,758 A 3/1907 Frye
918,391 A 4/1909 Taarud
934,465 A 9/1909 Rust
1,185,684 A 6/1916 Kraft et al.
1,263,599 A 4/1918 Poole
1,282,980 A 10/1918 Takach
1,361,453 A 12/1920 Frey
1,451,136 A 4/1923 Allnut
1,576,211 A 3/1926 O'Kane
1,944,466 A 1/1934 Rubin
2,028,060 A 1/1936 Gilbert
2,064,695 A 12/1936 Sipe
2,112,641 A 3/1938 Wheaton
2,168,774 A 8/1939 Hurlburt
2,285,324 A 6/1942 Bennett
2,288,889 A 7/1942 Costello
2,369,736 A 2/1945 Hurt
2,372,218 A 3/1945 Manson et al.
2,415,150 A 2/1947 Stein
2,434,641 A 1/1948 Burns
2,456,689 A 12/1948 Dickey et al.
2,459,689 A 1/1949 Dickey et al.
2,482,198 A 9/1949 Melichar
2,549,597 A 4/1951 Harris
2,565,406 A 8/1951 Popovich
2,575,764 A 11/1951 Morner
2,604,641 A 7/1952 Reed
D167,871 S 9/1952 Vega
2,614,272 A 10/1952 Morner
2,672,628 A 3/1954 Spanel
2,701,579 A 2/1955 Hasselquist
2,741,780 A 4/1956 Kimbrig
2,767,735 A 10/1956 Darling
2,803,527 A 8/1957 Lundahl
2,823,668 A 2/1958 Van Court et al.
2,842,783 A 7/1958 Druck
2,853,720 A 9/1958 Friedlander
2,949,927 A 8/1960 Mackal
2,990,070 A 6/1961 Cushman
3,008,214 A 11/1961 Foster et al.
3,026,909 A 3/1962 Boteler
3,042,941 A 7/1962 Marcus
3,068,494 A 12/1962 Pinkwater
3,086,698 A 4/1963 Goldstein
3,095,901 A 7/1963 Larson et al.
3,099,386 A 7/1963 Pieper
3,112,502 A 12/1963 Forsburg
3,123,336 A 3/1964 Price
3,128,480 A 4/1964 Lineback
3,142,850 A 8/1964 De Boer
3,155,991 A 11/1964 Dunham
3,164,151 A 1/1965 Vere Nicoll
3,208,721 A 9/1965 McHugh
3,274,624 A 9/1966 Noerdinger
3,367,819 A 2/1968 Schlag
3,403,696 A 10/1968 Pynchon
3,424,151 A 1/1969 Ericson
3,459,363 A 8/1969 Miller
3,462,775 A 8/1969 Markwitz et al.
3,505,695 A 4/1970 Bishaf et al.
3,511,472 A 5/1970 Zimmerman
3,561,435 A 2/1971 Nicholson
3,563,676 A 2/1971 Coovert et al.
D220,953 S 6/1971 Des Pres
3,610,235 A 10/1971 Sivash
3,653,084 A 4/1972 Hartman
3,665,958 A 5/1972 Dunkelis
3,667,075 A 6/1972 Ballard et al.
3,667,625 A 6/1972 Lucas
3,719,401 A 3/1973 Peruglia
3,755,832 A 9/1973 Bennett
3,762,404 A 10/1973 Sakita
3,772,717 A 11/1973 Yuen et al.
3,785,395 A 1/1974 Andreasson
3,790,975 A 2/1974 Philipp et al.
3,798,686 A 3/1974 Gaiser
3,813,716 A 6/1974 Francis
3,829,918 A 8/1974 Stamberger
3,831,628 A 8/1974 Kintner et al.
3,840,922 A 10/1974 Morrison et al.
3,864,766 A 2/1975 Prete, Jr.
3,877,092 A 4/1975 Gaiser
3,898,703 A 8/1975 Stamberger
3,899,797 A 8/1975 Gunst
3,995,653 A 12/1976 Mackal et al.
4,025,974 A 5/1977 Lea et al.
4,068,334 A 1/1978 Randall
4,080,105 A 3/1978 Connell
4,091,482 A 5/1978 Malcolm
4,099,773 A 7/1978 Chang
4,146,069 A 3/1979 Angarola et al.
4,146,070 A 3/1979 Angarola et al.
4,149,285 A 4/1979 Stanton
4,168,063 A 9/1979 Rowland
4,169,295 A 10/1979 Darling
4,175,297 A 11/1979 Robbins et al.
D253,983 S 1/1980 McRight
4,213,745 A 7/1980 Roberts
4,225,989 A 10/1980 Corbett et al.
4,266,298 A 5/1981 Graziano
4,273,310 A 6/1981 Ginzler
4,300,759 A 11/1981 Caplan
4,317,244 A 3/1982 Balfour-Richie
4,348,779 A 9/1982 Leber
4,371,999 A 2/1983 Reid
4,382,306 A 5/1983 Lickert
4,394,784 A 7/1983 Swenson et al.
4,405,129 A 9/1983 Stuckey
4,489,452 A 12/1984 Lickert
4,521,166 A 6/1985 Phillips
4,594,743 A 6/1986 Owen et al.
4,644,597 A 2/1987 Walker
4,678,014 A 7/1987 Owen et al.
4,678,410 A 7/1987 Kullen
4,692,091 A 9/1987 Ritenour
4,711,275 A 12/1987 Ford et al.
4,734,017 A 3/1988 Levin
4,768,247 A 9/1988 Beier
4,807,554 A 2/1989 Chi-Hung
4,829,614 A 5/1989 Harper
4,829,616 A 5/1989 Walker
4,862,533 A 9/1989 Adams, III
4,890,344 A 1/1990 Walker
4,891,855 A 1/1990 Cheng-Chung
4,896,389 A 1/1990 Chamberland
4,897,890 A 2/1990 Walker
4,905,332 A 3/1990 Wang
4,911,405 A 3/1990 Weissgerber
4,948,092 A 8/1990 Kasper et al.
4,964,183 A 10/1990 LaForce, Jr.
4,970,741 A 11/1990 Spina
4,977,633 A 12/1990 Chaffee
4,982,466 A 1/1991 Higgins et al.
4,986,738 A 1/1991 Kawasaki et al.
4,990,060 A 2/1991 Cheng-Chung
5,025,894 A 6/1991 Yamasaki
5,037,062 A 8/1991 Neuhaus
5,040,555 A 8/1991 Wang
5,044,030 A 9/1991 Balaton
5,051,060 A 9/1991 Fleischmann et al.
5,052,894 A 10/1991 Rimington
5,060,324 A 10/1991 Marinberg et al.
5,068,933 A 12/1991 Sexton
5,071,378 A 12/1991 Wang
5,079,785 A 1/1992 Garcia
5,085,214 A 2/1992 Barrett
5,102,365 A 4/1992 Wang
5,117,517 A 6/1992 Su
D328,324 S 7/1992 Wang
5,144,708 A 9/1992 Pekar
5,163,196 A 11/1992 Graebe et al.

(56) References Cited

U.S. PATENT DOCUMENTS 5,170,522 A 12/1992 Walker
5,178,523 A 1/1993 Cheng-Chung
5,186,667 A 2/1993 Wang
5,203,808 A 4/1993 Ide
D335,999 S 6/1993 Van Driessche
5,216,769 A 6/1993 Eakin
5,226,184 A 7/1993 Cheng
5,243,722 A 9/1993 Gusakov
5,249,319 A 10/1993 Higgs
D341,983 S 12/1993 Wang
5,267,363 A 12/1993 Chaffee
D343,980 S 2/1994 Torchia
5,288,286 A 2/1994 Davis
5,367,726 A 11/1994 Chaffee
5,406,661 A 4/1995 Pekar
5,423,094 A 6/1995 Arsenault et al.
5,450,858 A 9/1995 Zablotsky et al.
5,474,361 A 12/1995 Hwang et al.
5,491,854 A 2/1996 Music
5,493,742 A 2/1996 Klearman
5,494,258 A 2/1996 Weissgerber et al.
5,494,418 A 2/1996 Moriya et al.
5,503,618 A 4/1996 Rey
5,509,154 A 4/1996 Shafer et al.
5,511,942 A 4/1996 Meier
5,535,849 A 7/1996 Few
5,581,304 A 12/1996 Wang
5,588,811 A 12/1996 Price
5,598,593 A 2/1997 Wolfe
5,606,756 A 3/1997 Price
5,619,764 A 4/1997 Lopau
5,638,565 A 6/1997 Pekar
5,652,484 A 7/1997 Shafer et al.
5,689,845 A 11/1997 Sobieralski
5,699,569 A 12/1997 Schwarz-Zohrer
D391,435 S 3/1998 Song et al.
5,727,270 A 3/1998 Cope et al.
5,745,942 A 5/1998 Wilkerson
5,746,873 A 5/1998 Graf
5,839,139 A 11/1998 Fink
5,845,352 A 12/1998 Matsler et al.
5,857,841 A 1/1999 Kobayashi et al.
D405,636 S 2/1999 Stewart
5,890,882 A 4/1999 Feldman
5,893,609 A 4/1999 Schmidt
5,902,011 A 5/1999 Hand et al.
5,903,941 A 5/1999 Shafer et al.
5,904,172 A 5/1999 Gifft et al.
5,941,272 A 8/1999 Feldman
5,947,563 A 9/1999 Klimenko
5,951,111 A 9/1999 Klimenko
D414,976 S 10/1999 Su et al.
5,960,495 A 10/1999 Hsu et al.
5,962,159 A 10/1999 Satou et al.
5,963,997 A 10/1999 Hagopian
5,970,545 A 10/1999 Garman et al.
6,008,598 A 12/1999 Luff et al.
6,032,080 A 2/2000 Brisbane et al.
6,037,723 A 3/2000 Shafer et al.
6,047,425 A 4/2000 Khazaal
6,073,289 A 6/2000 Bolden et al.
6,076,214 A 6/2000 Klimenko
6,085,555 A 7/2000 Wu et al.
6,098,000 A 8/2000 Long et al.
6,099,248 A 8/2000 Mumm et al.
6,102,759 A 8/2000 Klimenko
6,108,844 A 8/2000 Kraft et al.
6,129,524 A 10/2000 Woollenweber et al.
6,131,219 A 10/2000 Roberts
6,148,461 A 11/2000 Cook et al.
6,152,530 A 11/2000 Hsu et al.
6,164,314 A 12/2000 Saputo et al.
6,189,168 B1 2/2001 Graebe
6,206,654 B1 3/2001 Cassidy
D441,586 S 5/2001 Su
6,224,444 B1 5/2001 Klimenko
6,237,621 B1 5/2001 Chaffee
6,237,653 B1 5/2001 Chaffee
6,240,584 B1 6/2001 Perez et al.
D446,284 S 8/2001 Chaffee
D448,229 S 9/2001 Su et al.
6,283,056 B1 9/2001 Tchaikovsky
6,287,095 B1 9/2001 Saputo et al.
6,296,459 B1 10/2001 Saputo et al.
6,302,145 B1 10/2001 Ellis et al.
6,332,760 B1 12/2001 Chung
6,397,417 B1 6/2002 Switlik
6,397,419 B1 6/2002 Mechache
6,439,264 B1 8/2002 Ellis et al.
6,446,289 B1 9/2002 Su et al.
D464,225 S 10/2002 Boso et al.
6,483,264 B1 11/2002 Shafer et al.
6,487,737 B1 12/2002 Futagami
6,530,751 B1 3/2003 Song et al.
6,543,073 B2 4/2003 Wu
6,550,086 B2 4/2003 Boyd
6,565,315 B1 5/2003 Bertels et al.
6,568,011 B2 5/2003 Fisher et al.
6,571,412 B1 6/2003 Wu
6,651,283 B1 11/2003 Cook et al.
6,659,737 B2 12/2003 Bader et al.
6,679,686 B2 1/2004 Wang
6,701,559 B2 3/2004 Boso et al.
6,709,246 B2 3/2004 Boyd
6,715,172 B2 4/2004 Leventhal et al.
6,719,401 B2 4/2004 Takahashi
6,722,306 B1 4/2004 Wang
6,733,254 B1 5/2004 Yen
6,793,469 B2 9/2004 Chung
6,836,914 B1 1/2005 Tsai
6,955,527 B2 10/2005 Yen
7,025,576 B2 * 4/2006 Chaffee ..... 417/366
7,039,972 B2 * 5/2006 Chaffee ..... 5/706
7,120,955 B2 10/2006 Wang
7,127,762 B1 10/2006 Lau
7,152,265 B2 12/2006 Chung
7,198,076 B2 4/2007 Wu
7,246,393 B2 7/2007 Westendorf et al.
7,246,394 B2 7/2007 Wang
7,284,291 B2 10/2007 Wang
7,299,513 B1 11/2007 Barrett et al.
7,306,694 B2 12/2007 Wang
7,313,837 B2 1/2008 Wang
7,328,472 B2 2/2008 Chaffee
7,334,274 B2 2/2008 Wang
7,475,440 B2 1/2009 Chaffee
7,588,425 B2 9/2009 Chung
7,644,724 B2 1/2010 Chaffee
7,739,763 B2 6/2010 Wang et al.
7,788,751 B1 9/2010 Diemer et al.
8,016,572 B2 * 9/2011 Chaffee ..... 417/366
8,210,834 B2 7/2012 Tsai
8,225,444 B2 7/2012 Chaffee
8,336,143 B2 12/2012 Lemmer
8,434,177 B2 5/2013 Chaffee
8,684,030 B2 4/2014 Chaffee
8,776,293 B2 * 7/2014 Chaffee ..... 5/655.3
2001/0026763 A1 10/2001 Chung
2001/0044969 A1 11/2001 Chaffee
2002/0050010 A1 5/2002 Shimada
2002/0116765 A1 8/2002 Smith et al.
2002/0184710 A1 12/2002 Chaffee
2002/0194678 A1 12/2002 Chung
2003/0003001 A1 1/2003 Chaffee
2003/0024050 A1 2/2003 Boso et al.
2003/0028971 A1 2/2003 Chaffee
2003/0066489 A1 4/2003 Whitehill
2003/0099560 A1 5/2003 Wang
2003/0115000 A1 6/2003 Bodas
2003/0192123 A1 10/2003 Chaffee
2003/0192127 A1 10/2003 Cook et al.
2003/0200611 A1 10/2003 Chaffee
2003/0205273 A1 11/2003 Chaffee
2003/0215340 A1 11/2003 Chung

(56) References Cited

U.S. PATENT DOCUMENTS

| | | | |
|---|---|---|---|
| 2004/0037717 | A1 | 2/2004 | Wang |
| 2004/0089835 | A1 | 5/2004 | Schreiner |
| 2004/0107503 | A1 | 6/2004 | Tu |
| 2004/0168256 | A1 | 9/2004 | Chaffee |
| 2004/0241014 | A1 | 12/2004 | Yen |
| 2005/0044634 | A1 | 3/2005 | Wang |
| 2005/0047923 | A1 | 3/2005 | Li et al. |
| 2005/0118046 | A1 | 6/2005 | Wang |
| 2005/0186097 | A1 | 8/2005 | Wang |
| 2006/0053561 | A1 | 3/2006 | Metzger et al. |
| 2006/0123549 | A1 | 6/2006 | Chaffee |
| 2006/0143832 | A1 | 7/2006 | Chaffee |
| 2006/0162779 | A1 | 7/2006 | Chaffee |
| 2006/0253991 | A1 | 11/2006 | McClintock |
| 2007/0256245 | A1 | 11/2007 | Kammer et al. |
| 2008/0109962 | A1 | 5/2008 | Wang et al. |
| 2008/0229508 | A1 | 9/2008 | Chaffee |
| 2009/0049617 | A1 | 2/2009 | Chaffee |
| 2009/0300846 | A1 | 12/2009 | Chaffee |
| 2011/0167564 | A1 | 7/2011 | Chaffee |
| 2012/0272456 | A1 | 11/2012 | Lemmer |
| 2014/0053339 | A1 | 2/2014 | Chaffee |
| 2014/0130261 | A1 | 5/2014 | Gumbrecht |

FOREIGN PATENT DOCUMENTS

| | | | |
|---|---|---|---|
| DE | 1808122.6 | | 5/1970 |
| DE | 4000629 | A1 | 7/1990 |
| DE | 4413445 | C2 | 2/1996 |
| DE | 29721150 | U1 | 2/1998 |
| FR | 2721581 | A3 | 12/1995 |
| GB | 903557 | A | 8/1962 |
| GB | 1381952 | A | 1/1975 |
| GB | 2198341 | A | 6/1988 |
| GB | 2378987 | A | 2/2003 |
| JP | S54-24711 | | 1/1979 |
| JP | 58-53965 | | 4/1983 |
| JP | 61-126241 | | 6/1986 |
| JP | 05-063354 | B2 | 3/1993 |
| JP | 05137809 | A | 6/1993 |
| JP | 405137809 | A | 6/1993 |
| JP | 0714273 | | 3/1995 |
| JP | H8-93683 | | 4/1996 |
| JP | H11-182439 | | 7/1999 |
| JP | 3023725 | B2 | 3/2000 |
| JP | 2001523322 | A | 11/2001 |
| JP | 3267013 | B2 | 3/2002 |
| WO | 9305684 | A1 | 4/1993 |
| WO | 9803810 | A1 | 1/1998 |
| WO | 0040882 | A1 | 7/2000 |
| WO | 0187121 | A2 | 11/2001 |
| WO | 03093709 | A1 | 11/2003 |
| WO | 2004045343 | A1 | 6/2004 |

OTHER PUBLICATIONS

Imaginair Aero Product Catalog, 2000 Imaginair Incorporated, Wauconda, IL, USA.

Imaginair by aero, Instruction Manual, Dec. 1999, Imaginair Incorporated, Wauconda, IL, USA.

International Search Report for International Application No. PCT/US02/10073 mailed Jul. 31, 2002, 2 pages.

Supreme Fast-Fill, 2000 Intex Recreation Corpl, Long Beach, CA, USA.

* cited by examiner

PUMP WITH AXIAL CONDUIT

RELATED APPLICATIONS

This application claims the benefit under 35 U.S.C. §120 as a continuation of U.S. application Ser. No. 13/205,271, filed on Aug. 8, 2011, now U.S. Pat. No. 8,776,293, which claims priority under 35 U.S.C. §120 as a continuation of U.S. patent application Ser. No. 11/339,025, filed Jan. 25, 2006, now U.S. Pat. No. 8,016,572, which claims priority under 35 U.S.C. §120 as a continuation of U.S. patent application Ser. No. 10/113,836, filed Apr. 1, 2002, now U.S. Pat. No. 7,025,576, which claims priority under 35 U.S.C. §119(e) to U.S. Provisional Patent Application No. 60/280,257, filed Mar. 30, 2001, and to U.S. Provisional Patent Application No. 60/280,040, filed Mar. 30, 2001; U.S. patent application Ser. No. 10/113,836, now U.S. Pat. No. 7,025,576, also claims priority under 35 U.S.C. §120 as a continuation-in-part of U.S. application Ser. No. 09/859,706, filed May 17, 2001, now U.S. Pat. No. 7,039,972, which claims priority under 35 U.S.C. §119 (e) to U.S. Provisional Patent Application No. 60/204,836, filed May 17, 2000, and to U.S. Provisional Patent Application No. 60/280,040; U.S. patent application Ser. No. 10/113,836, now U.S. Pat. No. 7,025,576, also claims priority under 35 U.S.C. §120 as a continuation-in-part of International PCT Application No. PCT/US01/15834, filed May 17, 2001, which claims priority under 35 U.S.C. §119(e) to U.S. Provisional Patent Application No. 60/204,836, and to U.S. Provisional Patent Application No. 60/280,040. All applications referenced above are hereby incorporated herein by reference in their entireties for all purposes.

BACKGROUND

1. Field of the Invention

The present invention is related to pumps and, more specifically, to pumps for use with inflatable devices.

2. Related Art

A variety of methods of providing air or other fluids to inflatable devices have been proposed. Typically a pump is used to supply air to an orifice in the inflatable device. Such pumps may include a motor that drives an impeller, moving the air into the inflatable device. Motorized pumps may be powered by electricity. Typically, such electricity is provided by a connection to standard house current or, where portability is desired, by batteries.

SUMMARY

In one aspect, a pump for moving air includes an inlet, an outlet, an outer housing adapted to couple to an inflatable device, and an inner housing located within the outer housing. An air conduit is defined between the inner housing and the outer housing. A motor is at least partly positioned within the inner housing, and a plurality of vanes are positioned within the air conduit.

According to one embodiment, the air conduit is located annularly about an axis of the pump. In another embodiment, the pump includes an impeller which is located outside the air conduit defined between the inner housing and the outer housing.

In a further embodiment, the inflatable device includes an inflatable bladder, the pump is adapted to engage with a valve assembly, and a majority of the pump and a majority of the valve assembly are positioned within a profile of the inflatable bladder when the pump is engaged with the valve assembly.

In another aspect, a pump for moving air includes an inlet, an outlet, an outer housing adapted to couple to an inflatable device, and an inner housing located within the outer housing. An air conduit is defined between the inner housing and the outer housing. A motor is at least partly positioned within the inner housing and a vane is positioned within the air conduit. The air conduit is located annularly about an axis of the pump for a majority of a distance between the inlet and the outlet.

BRIEF DESCRIPTION OF DRAWINGS

The foregoing and other advantages of the present invention will be more fully appreciated with reference to the following drawings in which.

DETAILED DESCRIPTION

Figure 1:
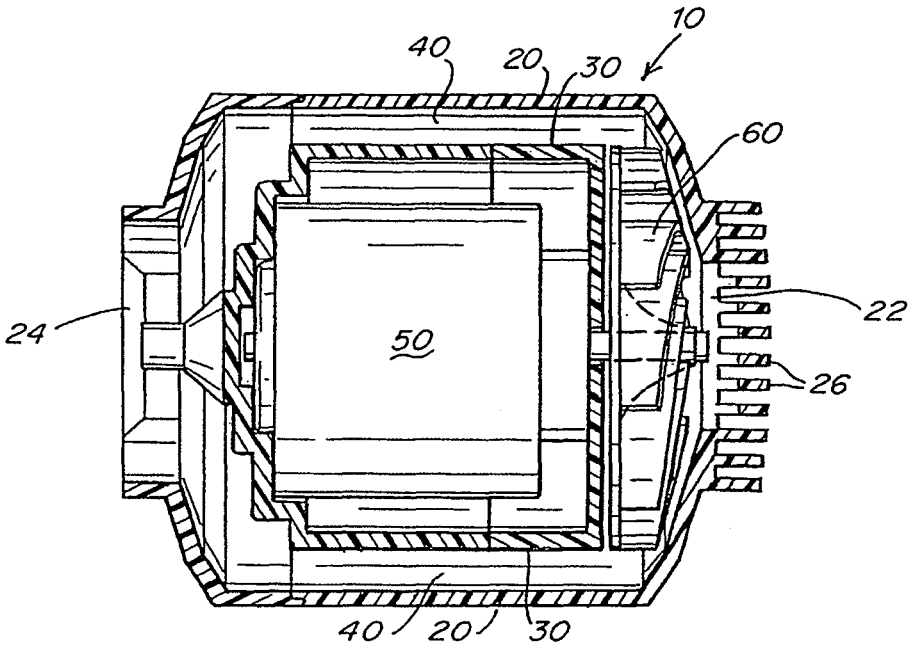
FIG. 1 is a cross-sectional, elevational view of a pump according to one embodiment of the present invention.
Figure 2:
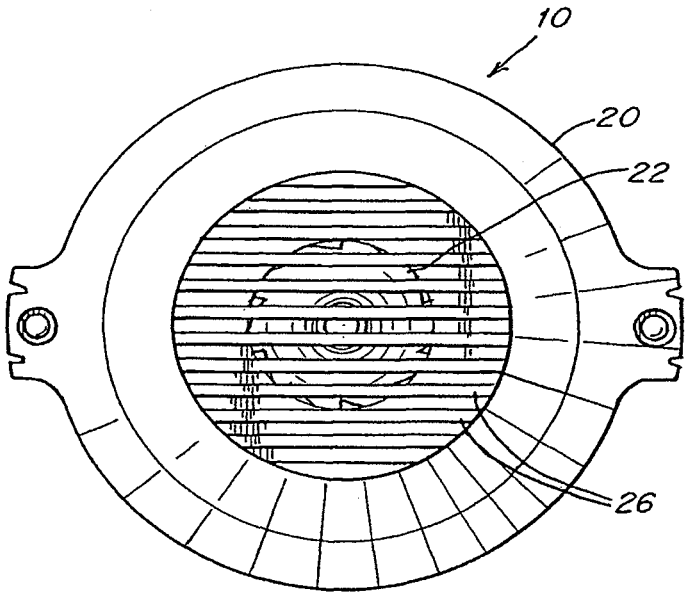
FIG. 2 is an axial, elevational view of the pump of FIG. 1.

The present invention is directed to a pump with an axial fluid conduit. In one embodiment, the pump of the present invention may include an outer housing and an inner housing positioned within the outer housing. The axial fluid conduit may be defined between the inner housing and the outer housing. A motor may be positioned within the inner housing and an impeller positioned within the fluid conduit and connected to the motor.

Referring now to the figures, and, in particular, to FIGS. 1-2 and 5-6, one embodiment will be described. In this embodiment, the pump 10 may include an outer housing 20 and an inner housing 30 positioned within outer housing 20. A fluid conduit 40 may be defined between outer housing 20 and inner housing 30. A motor 50 may be positioned within inner housing 30 and an impeller 60 positioned within fluid conduit 40 and connected to motor 50. The connection may be any attachment known to those of skill in the art.

Outer housing 20 may be constructed in any manner and of any material(s) that render pump 10 sufficiently durable for its intended application and provide a suitable outer wall for fluid conduit 40. For example, outer housing 20 may be constructed of a lightweight, inexpensive, durable, and fluid-tight material. Outer housing 20 may also be shaped such that it is not cumbersome. For example, outer housing 20 may be ergonomically designed. Materials for construction of outer housing 20 include a wide variety of relatively rigid thermoplastics, such as polyvinyl chloride (PVC) or acrylonitrile-butadiene-sytrene (ABS). However, outer housing 20 may also be constructed of other materials, such as metals, metal alloys, and the like.

Outer housing 20 may be constructed in any shape capable of containing an inner housing 30. For example, outer housing 20 may be constructed generally cylindrically. In some embodiments, outer housing 20 may be larger (e.g., have a larger diameter) where it contains inner housing 30, and smaller (e.g., have a smaller diameter) at an inlet 22 and an outlet 24 of outer housing 20. It should be understood that inlet 22 and outlet 24 have been labeled arbitrarily and that fluid can be moved through pump 10 in either direction. For example, pump 10 may be operated in a first direction to push air from inlet 22 to outlet 24 or in a second direction to pull air from outlet 24 to inlet 22.

Inlet 22 may be constructed to facilitate air flow into fluid conduit 40. For example, inlet 22 may be constructed to prevent blockage of inlet 22. In one embodiment, inlet 22 includes protrusions 26 to inhibit blockage of inlet 22. Inlet 22 may also be constructed to prevent foreign objects from contacting impeller 60. For example, inlet 22 may be constructed to have multiple small openings that are relatively difficult for a foreign object, such as a finger, to enter. In a preferred embodiment, protrusions 26 of inlet 22 are constructed as slats, inhibiting foreign objects from contacting impeller 60.

Outlet 24 may be constructed to provide fluid to a desired location. For example, outlet 24 may be constructed to provide fluid to an inflatable device. In one embodiment, outlet 24 includes structure to lock to an inlet of an inflatable device and to bias a valve of the inlet to an open position when the pump is moving fluid to the inflatable device. In another embodiment, the pump may include a solenoid to bias open the valve when the pump is adding fluid to, drawing fluid from, the inflatable device Inner housing 30 may also be constructed in any manner and of any material(s) that are suitable for containment within outer housing 20, for serving as the inner wall of fluid conduit 40 and for containing motor 50. For example, inner housing 30 may be constructed to fit within outer housing 20, so as to provide the fluid conduit 40. In one embodiment, inner housing 30 is constructed such that it is evenly spaced from an inner surface of outer housing 20. The shape of inner housing 30 may be selected to be compatible with the shape of outer housing 20. For example, where outer housing 20 is generally cylindrical, inner housing 30 may also be generally cylindrical.

Inner housing 30 may also be constructed to securely contain motor 50. For example, inner housing 30 may include internal structure to maintain motor 50 in a desired location. Inner housing 30 may include structure to hold motor 50 in a desired location without allowing undesired vibration or noise. In one embodiment, inner housing 30 may also be constructed to contain one or more batteries to provide electrical power to motor 50. Inner housing 30 may be constructed of any material(s) sufficiently durable to contain motor 50 and suitable for use with the fluid to be pumped. For example, inner housing 30 may be constructed out of any of the same materials as outer housing 20 described supra.

Fluid conduit 40 may be defined by the construction of outer housing 20 and inner housing 30. Fluid conduit 40 may provide sufficient space for fluid flow, so as not to create a significant pressure drop. Fluid conduit 40 may also be regular in shape and substantially free of irregularities that may interfere with efficient fluid flow, potentially creating turbulence, noise and pressure loss.

Fluid conduit 40 may include structure to improve the flow of fluid through fluid conduit 40 and enhance pressurization. Improving the flow through fluid conduit 40 may decrease turbulence and generally result in a pump that is quieter and more efficient. Flow is preferably directed such that the fluid is not forced to make any sudden changes in direction. Fluid conduit 40 is generally axial in direction and impeller 60 will generally impart a rotational force on the fluid relative to the axis of fluid conduit 40. Accordingly, any structure included to improve the flow of fluid through fluid conduit 40 is preferably constructed so as to not inhibit the generally axial movement of fluid through fluid conduit 40, and may allow for the rotation of fluid within fluid conduit 40.

Inefficient fluid flow is preferred to be avoided throughout the length of fluid conduit 40. Accordingly, in a preferred embodiment, the pump is provided with structure to improve the flow of fluid through fluid conduit 40 and enhance pressurization, the structure occupying a majority of fluid conduit 40. The structure for improving the fluid flow preferably occupies at least 75% of the length of fluid conduit 40, even more preferably 90% of the length of fluid conduit 40, and most preferably substantially all of the length of fluid conduit 40, improving flow throughout fluid conduit 40. By way of illustration, what is meant by the structure occupies a majority of fluid conduit 40 is that the structure extends at least half way through the length of fluid conduit 40, not that it fills more than half the void space in fluid conduit 40. A structure occupying the majority of fluid conduit 40 is substantially different from an arrangement that simply directs fluid from an impeller into an open fluid conduit because it controls the fluid flow through a greater portion of fluid conduit 40 and thus is better able to improve fluid flow.

Figure 3:
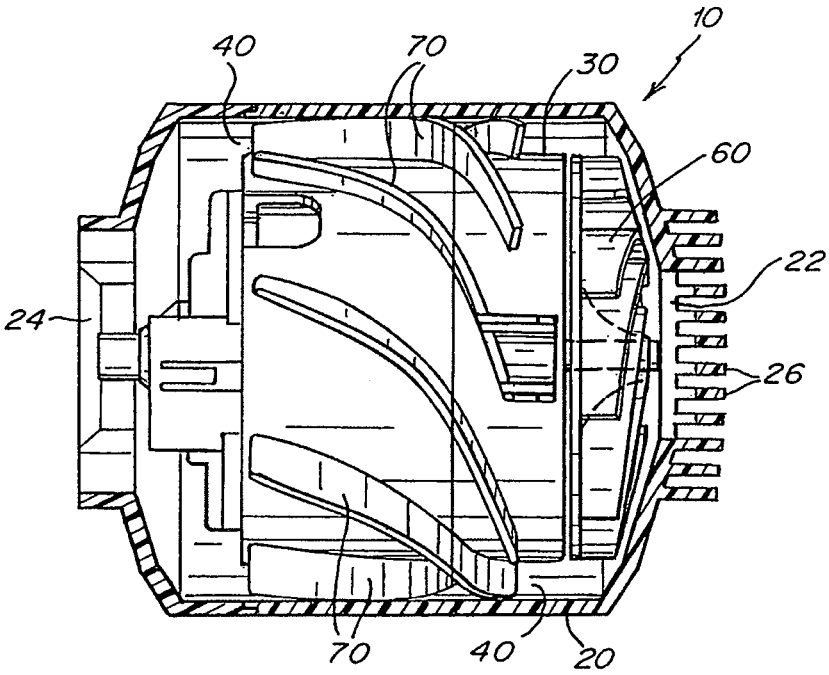
FIG. 3 is a cross-sectional, elevational view of a pump according to another embodiment of the present invention.
Figure 4:
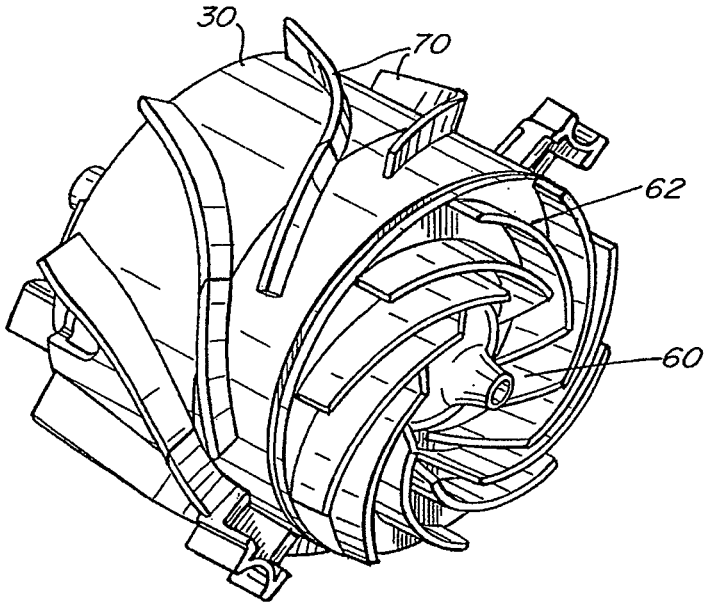
FIG. 4 is a perspective, elevational view of one aspect of the present invention.
Figure 5:
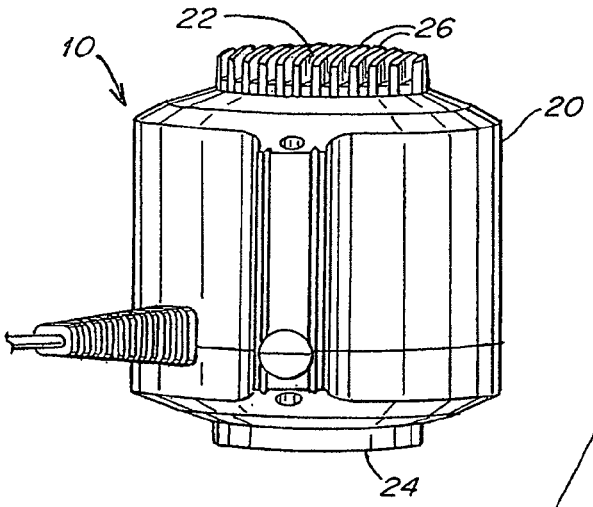
FIG. 5 is a side view of a pump according to one embodiment of the present invention.
Figure 6:
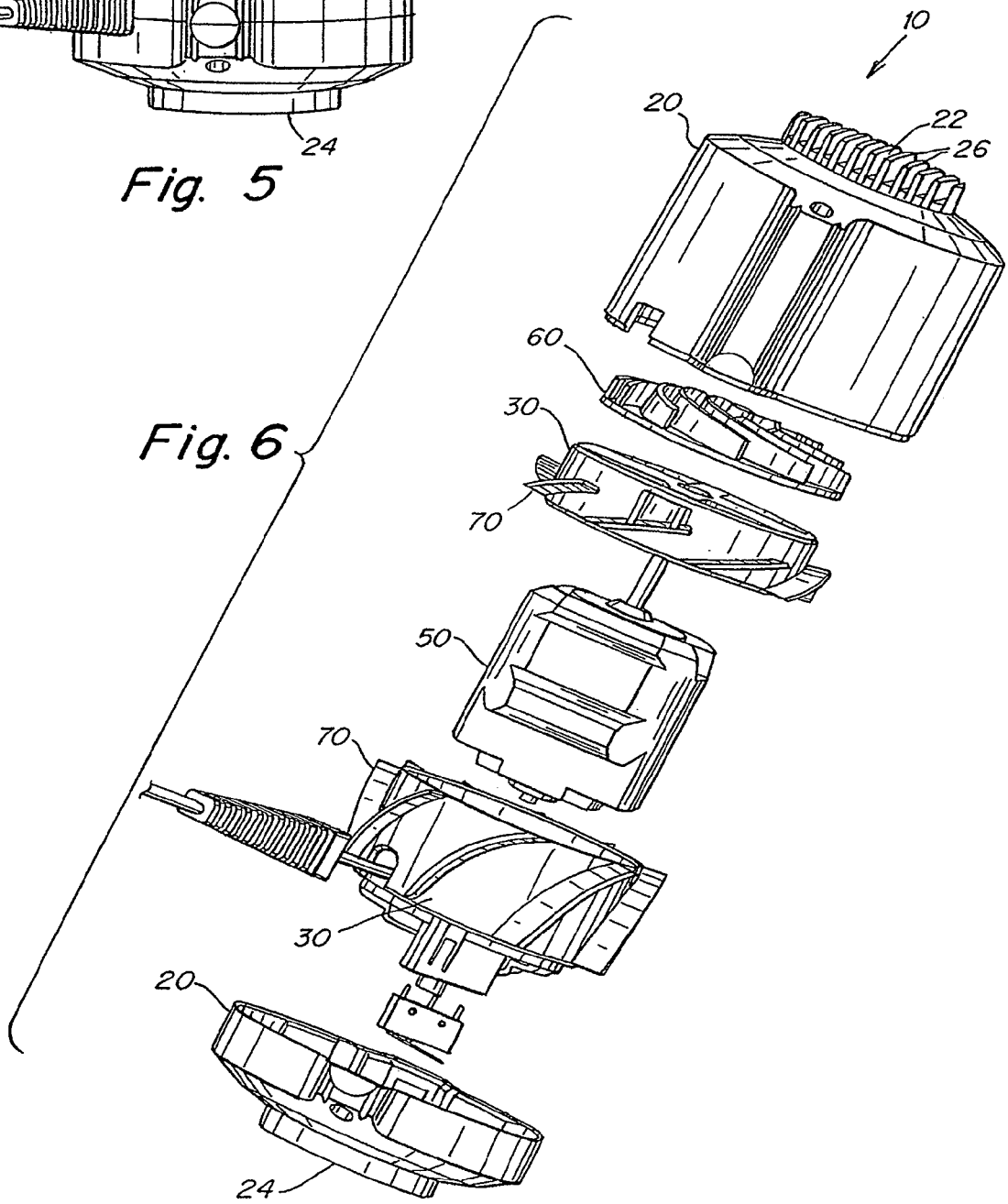
FIG. 6 is an exploded view of the pump of FIG. 6.

In one embodiment, structure to improve the flow of fluid through fluid conduit 40 and enhance pressurization includes one or more structures that direct flow of fluid. For example, referring to FIGS. 3-4 and 6, fluid conduit 40 may include vanes 70 shaped to improve fluid flow through fluid conduit 40. Vanes 70 may be constructed to direct fluid flow within fluid conduit 40 and to bridge fluid conduit 40 from an inner surface of outer housing 20 to an outer surface of inner housing 30, forcing fluid to flow through the channels defined by the vanes. However, it should be understood that vanes 70 need not extend between the inner surface of outer housing 20 and the outer surface of inner housing 30 in all embodiments, or throughout the entire fluid conduit in such embodiments where they do so extend.

Vanes 70 may be constructed to minimize any abrupt changes in fluid flow associated with inefficient flow and increased pressure drop. For example, vanes 70 may be swept in a direction of the rotation imparted by impeller 60, and may direct the flow generally axially along fluid conduit 40. As illustrated, in one embodiment, vanes 70 straighten along the length of fluid conduit 40, allowing them to gradually redirect the air from primarily rotational movement to primarily axial movement. Vanes 70 are preferably free of any rough edges or dead end pockets that may increase fluid resistance.

It should be appreciated that structure to improve the flow of fluid through fluid conduit 40 and enhance pressurization may be particularly useful where fluid conduit 40 is relatively narrow. For example, where it is desired to make pump 10 portable, yet powerful, it may be desired to make inner housing 30 relatively large to house a larger motor, while making outer housing 20 relatively small to reduce the overall size of the device. In such an embodiment, fluid conduit 40 may be relatively narrow. For example, the average distance between an inner surface of outer housing 20 to an outer surface of inner housing 30 may preferably be about 25%, more preferably about 10%, even more preferably about 5%, or less of the average diameter of outer housing 20. In the illustrated embodiment, the average distance between the inner surface of outer housing 20 to the outer surface of inner housing 30 is about 8% of the average diameter of outer housing 20. The narrowness of fluid conduit 40 may itself act as a structure to improve the flow of fluid, directing it axially along the fluid conduit, rather than allowing it to enter a relatively open area. Accordingly, a narrow fluid conduit may be sufficient is some embodiments to reduce inefficient flow.

Fluid conduit 40 may also include structure to maintain the shape of fluid conduit 40. For example, fluid conduit 40 may include structure to secure inner housing 30 relative to outer housing 20. In one embodiment, this structure may include one or more struts connecting an inner surface of outer housing 20 to the outer surface of inner housing 30. In another embodiment, one or more vanes 70 serve to both direct the fluid flow and maintain the relationship between the inner and outer housings.

Motor 50 may be any device capable of rotating impeller 60 to produce fluid flow through pump 10. For example, motor 50 may be a conventional electric motor. In one embodiment, motor 50 is preferably an efficient, lightweight motor. Motor 50 may also be relatively small, to reduce the overall size of pump 10. However, it is to be appreciated that even for a small overall size pump, the motor may still be relatively large compared to the overall size of the pump where it is desired to provide more pumping power.

Impeller 60 may be constructed in any manner and of any material(s) that allow impeller 60 to move fluid when rotated by motor 50. For example, impeller 60 may be constructed with fins 62 capable of forcing fluid into or out of pump 10, depending on the direction of rotation of impeller 60 Impeller 60 may be made of any material capable of maintaining a desired shape of impeller 60. For example, impeller 60 may be constructed of durable and lightweight material that is compatible with the fluid to be used in pump 10. For example, impeller 60 may be constructed of a thermoplastic, such as those mentioned for use in construction of outer housing 20.

Figure 7:
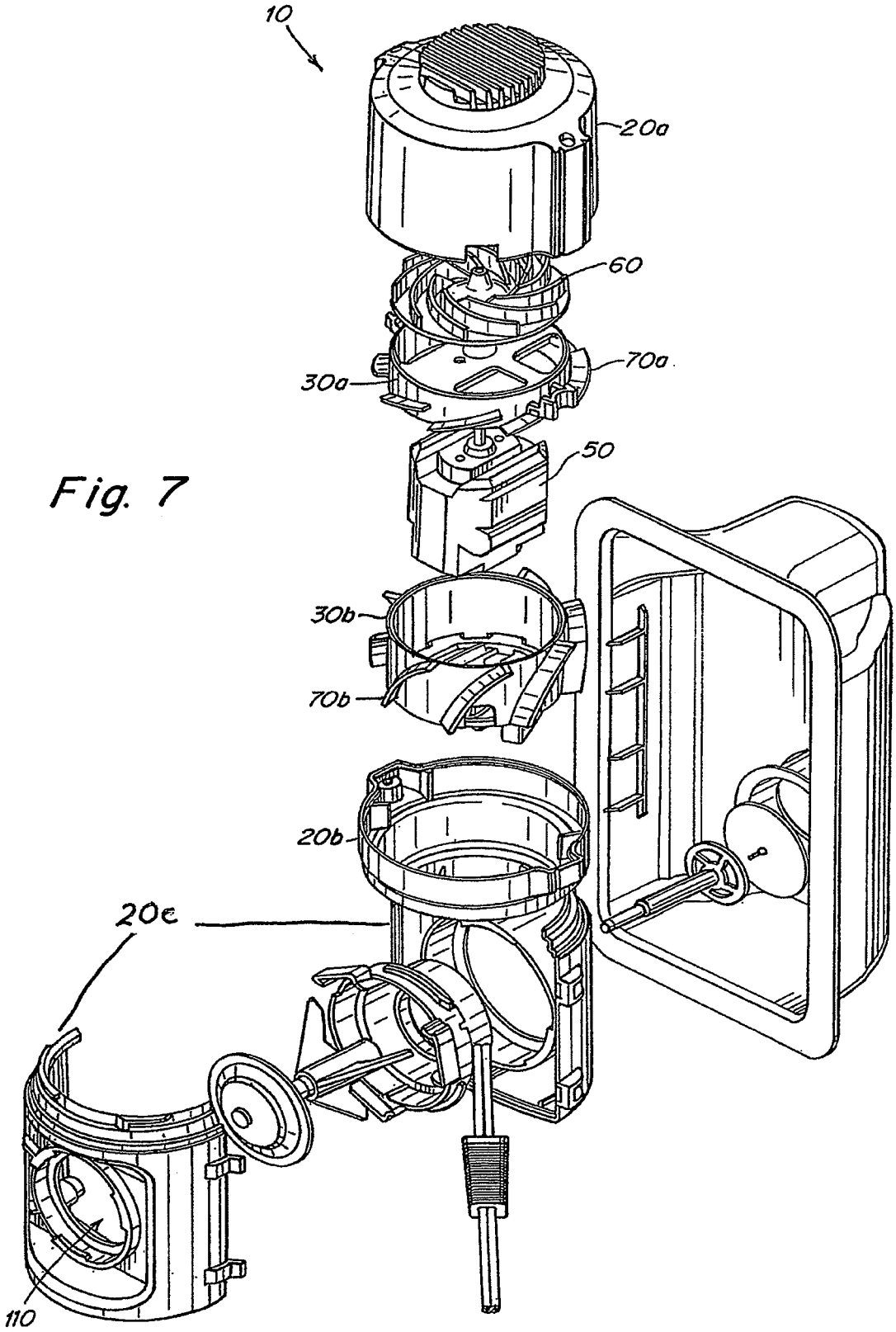
FIG. 7 is an exploded view of one aspect of the present invention.
Figure 8:
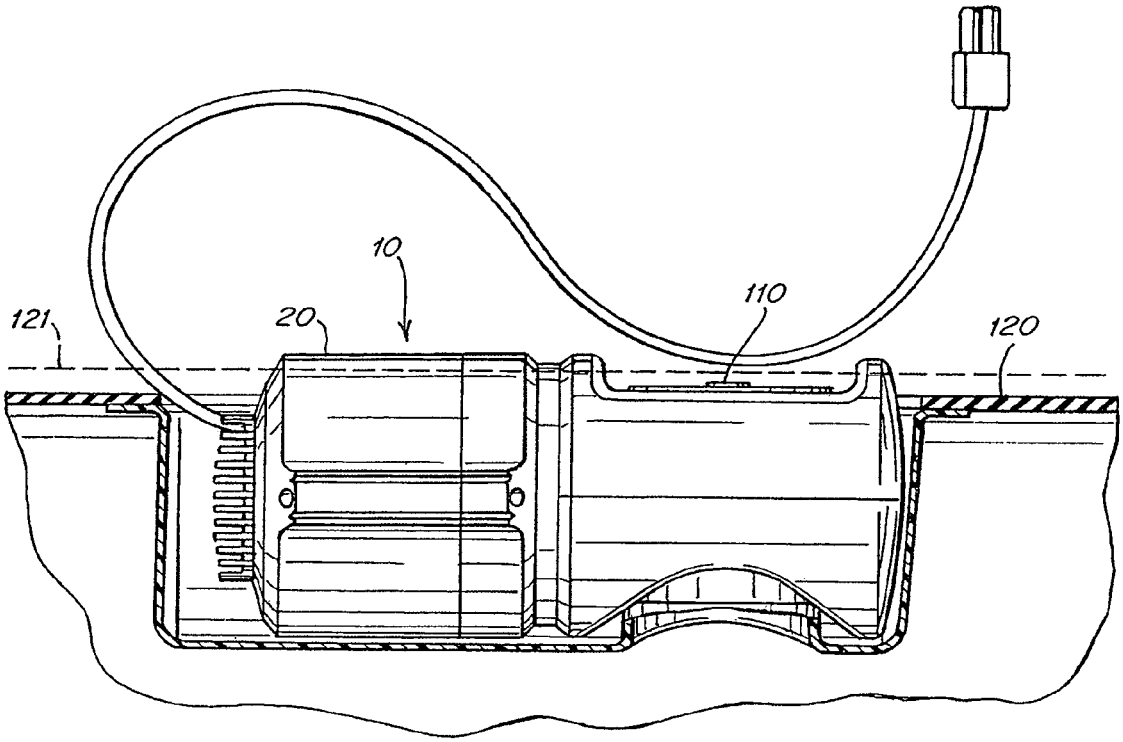
FIG. 8 is a cut-away view of the aspect of FIG. 7.
Figure 9:
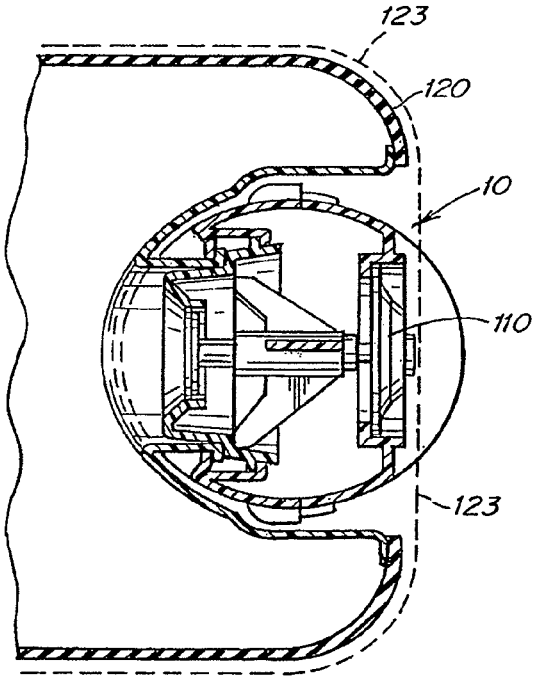
FIG. 9 is a cross-sectional view of the aspect of FIG. 7.

Referring to FIGS. 7-9, according to the present invention pump 10 may be used in a variety of ways. For example, pump 10 may be an independent device, such as a hand holdable pump, and may be placed in contact or connected with an inflatable device when it is desired to inflate the device, typically at a valve 110. In another embodiment, pump 10 may be incorporated into the inflatable device, detachably or permanently. One example embodiment of a pump 10 according to the present invention will now be described with reference to FIGS. 7-9.

In the example embodiment, pump 10 may be connected to a substantially fluid impermeable bladder 120 in an inflatable device. Where pump 10 is connected to bladder 120, pump 10 may be configured so that it does not interfere with the use of the inflatable device. For example the inflatable device may be constructed with pump 10 recessed into bladder 120, as illustrated in FIGS. 7-9. Where pump 10 is recessed within bladder 120, it is an advantage of this embodiment that pump 10 will not interfere with the use of the inflatable device. For example, the exterior profile (total volume and shape) of pump 10 and the inflated device in combination may be substantially the same as the exterior profile of the inflated device absent the combination, thus reducing the opportunity for pump 10 to impact or interfere with the use of the inflatable device. For example, where pump 10 is located within bladder 120 in a mattress application, it allows an inflatable standard sized mattress to fit into a standard sized bed frame. Where pump 10 is located within bladder 120, it may be sized such that it will not come into contact with bladder 120 when bladder 120 is inflated, except at the point(s) of connection. Accordingly, the pump of the present invention, which may be constructed so as to be small and hand-holdable, may be useful in such an application. For additional information regarding incorporating pumps at least partially within a bladder, see U.S. patent application Ser. No. 09/859,706, which is hereby incorporated by reference in its entirety.

Figure 10:
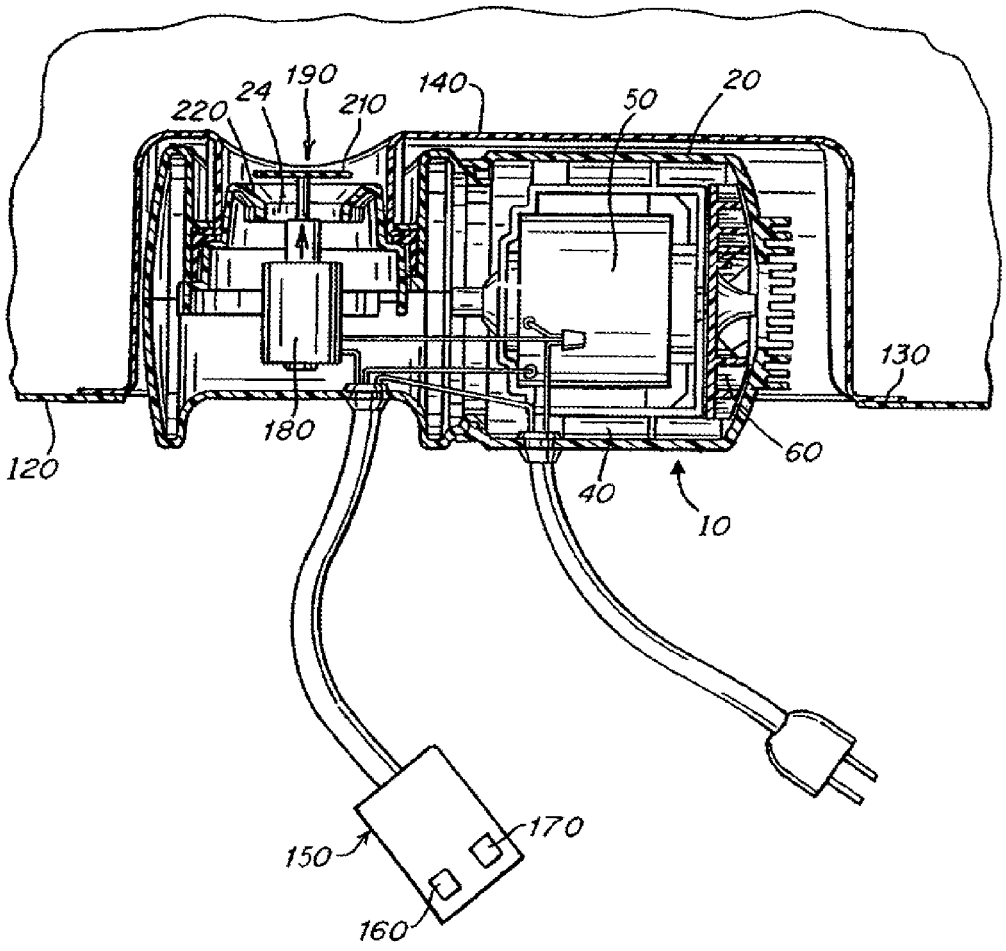
FIG. 10 is a side view of a pump according to one embodiment of the present invention.
Figure 11:
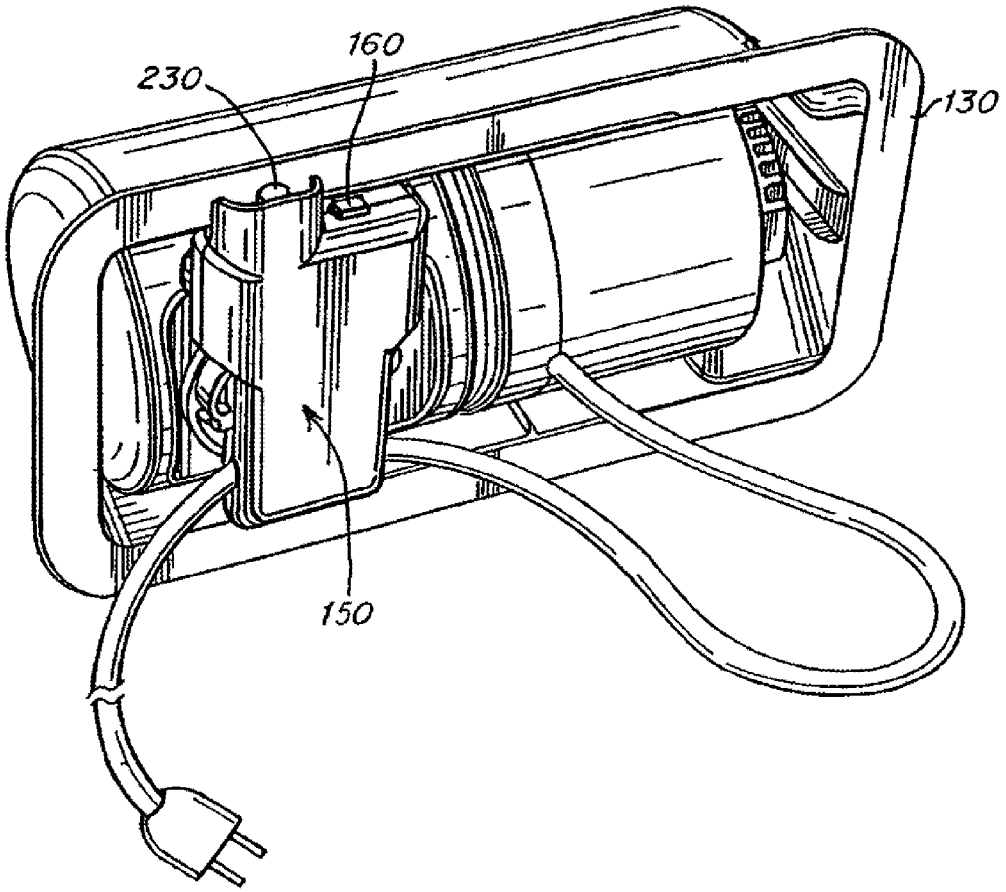
FIG. 11 is a perspective, elevational view of one aspect of the present invention.

Pump 10 may include structure to facilitate connection to bladder 120, for example, pump 10 may include a portion adapted to connect to bladder 120, such as a socket 130 as illustrated in FIGS. 10 and 11. Socket 130 may, for example, extend from outer housing 20 or may be a separate component connected to outer housing 20. As best seen in FIG. 10, socket 130 may include additional structure, such as a fluid impermeable wall 140, that may allow it to perform other functions in pump 10 in addition to providing a connection point for bladder 120. Where socket 130 is connected to outer housing 20, it may be connected anywhere and in any manner that allows it to fluid tightly connect pump 10 and bladder 120. For example, where socket 130 includes a fluid impermeable wall 140, socket 130 may be connected to outer housing 20 at or near an outlet 24 from outer housing 20.

Socket 130 may be constructed of any material that allows it to durably and fluid tightly connect pump 10 to bladder 120. For example, socket 130 may be constructed of a material that is more flexible than outer housing 20, but less flexible than bladder 120, bridging the flexibility gap between the two structures and resulting in a durable seal that may be created, for example, by heat sealing. One example of a suitable material of construction of socket 130 is PVC. The thickness of socket 130 may also affect its flexibility, with thinner sockets generally being more flexible than thicker sockets. Thus the thickness of socket 130 may be selected to provide a desired flexibility with a given material.

Where socket 130 connects to outer housing 20 or another potion of pump 10, it is preferred that such connection be reversible. For example socket 130 may snap or screw together with another portion of pump 10. Additional structure may be included to promote a fluid seal between socket 130 and the remainder of pump 10. For example, a seal, such as an o-ring, may be placed between socket 130 and the remainder of pump 10. It is also possible to construct the inflatable device such that bladder 120 and pump 10 are reversibly connected, rather than two portions of pump 10 being reversibly connected. In either case, the reversible connection allows the removal of portions of pump 10 for repair or replacement, preventing the entire inflatable device from having to be disposed of in the event of a failure of one component.

It will now be clear that pump 10 may be positioned within bladder 120 in a variety of ways. For example, pump 10 may include a socket 130 that positions it at least partially within bladder 120. The size and shape of socket 130 may be selected to control the portion of pump 10 that is positioned within bladder 120. Alternatively, bladder 120 may include a recess and pump 10 may be positioned within the recess and attached to bladder 120 only at a pump outlet, or at other locations within the recess.

Pump 10 may be operated by any conventional control mechanism, such as a conventional power switch. Pump 10 may also include a structure for controlling pump 10, such as an adjustment device 150. Adjustment device 150 may be separate or separable from pump 10 to allow pump 10 to be controlled remotely. In one embodiment, adjustment device 150 is a hand-held device for controlling pump 10.

Adjustment device 150 may include a structure for controlling the operation of pump 10. For example, adjustment device 150 may include a conventional power switch 160 that energizes and de-energizes the pump 10. Switch 160 may be any of the many well-known mechanisms for selectively connecting two conductors to supply electricity to a point of use. Switch 160 may allow the pump 10 to be energized such that it inflates bladder 120. Adjustment device 150 may also include a structure that directs the deflation of bladder 120. For example, a second switch may reverse the direction of the pump 10 to deflate bladder 120. In some embodiments, pump 10 may incorporate a valve which must be opened to allow deflation of bladder 120. In these embodiments, adjustment device 150 may also include structure to mechanically or electro-mechanically open a valve to allow deflation of bladder 120. For example, a switch 170 may act upon a mechanical opening mechanism or activate a solenoid 180 to open a valve, such as valve 190, and allow deflation of bladder 120. In one embodiment, the valve that is opened is a self-sealing valve, meaning that it is held closed, at least in part, by pressure within bladder 120. For example, a self-sealing valve may include a diaphragm 210 that is urged against a valve seat 220 by fluid pressure from within bladder 120. Optionally, switch 170 may also energize the pump 10 to withdrawn fluid from bladder 120.

In one embodiment, adjustment device 150 is connectable to pump 10. In this embodiment, adjustment device 150 may be connected to pump 10 at a conveniently located position such that it is easily found, particularly when pump 10 is in use. For example, where bladder 120 is a bed, pump 10 may be located at the head of the bed such that adjustment device 150 may be connected thereto for easy access when the bed is in use. Referring now to FIG. 11, any control elements on adjustment device 150, such as switches 160, 170 or a button 230 may be located on adjustment device 150 for easy access. For example, the control elements may be located on a top portion of adjustment device 150, as illustrated in FIG. 11. Attachment of adjustment device 150 to pump 10 may also facilitate deflation of bladder 120 with adjustment device 150. For example, where a valve must be opened to deflate bladder 120, adjustment device 150 may be in mechanical communication with pump 10 to disengage the valve. In one embodiment, a button 230 on adjustment device 150 may be in mechanical communication with pump 10 to open a valve.

An embedded pump 10 may be powered by conventional household current or by battery power. It should also be understood that pump 10 can be a hand holdable pump that is detachable from the inflatable device and is configured to mate with the inflatable device and to be embedded substantially within the bladder.

Outer housing (comprising multiple portions 20*a*, 20*b* and 20*c*) may house other structure in addition to inner housing (comprising two portions 30*a* and 30*b*, and corresponding vanes comprising two portions 70*a* and 70*b*) and motor 50. For example, outer housing may include fluid control structure such as valves. Valves may be operated manually, by using a solenoid, or using other conventional techniques. The structure to operate the valve may also be included within outer housing. For example, the outer housing can include portions 20*a*, 20*b* and 20*c*, where the portion 20*c* includes structure to operate the valve.

Having thus described certain embodiments of the present invention, various alterations, modifications and improvements will be apparent to those of ordinary skill in the art. Such alterations, variations and improvements are intended to be within the spirit and scope of the present invention. Accordingly, the foregoing description is by way of example and is not intended to be limiting. The present invention is limited only as defined in the following claims and the equivalents thereto.

What is claimed is:

1. An inflatable device comprising:

a fluid controller including:

a housing including an inlet fluidly coupled to ambient and an outlet fluidly coupled to an inflatable bladder, the housing defining an air conduit;

a valve assembly including a valve configured to fluidly couple the outlet of fluid controller to the inflatable device, the valve including a self-sealing diaphragm assembly configured to seal the outlet;

an electromechanical device configured to act on the self-sealing diaphragm assembly to open the valve;

a pump including a motor and an impeller located within the housing, the pump configured for moving air from the inlet through the air conduit to the outlet; and wherein the inflatable device includes an inflatable bladder;

wherein a majority of the fluid controller is positioned within a profile of the inflatable bladder in a mounted position and orientation, and wherein in the same mounted position and orientation of the fluid controller, the fluid controller is configured to electromechanically open the valve via the electromechanical device to permit air to exit the inflatable bladder through the fluid controller and to energize the pump to provide air to the inflatable bladder through the fluid controller.

2. The inflatable device of claim 1, further comprising at least one vane positioned within the air conduit, wherein the at least one vane includes a sweep.

3. The inflatable device of claim 2, wherein the fluid controller includes an axis, wherein the pump moves air through the air conduit parallel to the axis, and wherein the at least one vane is adapted to provide a substantially linear air flow.

4. The inflatable device of claim 1, wherein the housing is detachably coupled to a socket within a profile of the inflatable bladder, and wherein in the mounted position and orientation of the fluid controller, the majority of the pump and the valve assembly are located in the socket.

5. The inflatable device of claim 4, wherein the socket includes a wall, and wherein the valve assembly is disposed in an area defined by the wall.

6. The inflatable device of claim 4, wherein the pump is sized and configured to be hand held to allow a user to detachably connect the pump.

7. The inflatable device of claim 4, wherein an axis of the pump is perpendicular to an axis of the valve assembly when the pump is operably mounted.

8. An inflatable device comprising:

a fluid controller including:

a housing including an inlet fluidly coupled to ambient and an outlet fluidly coupled to an inflatable bladder, the housing defining an air conduit;

a valve assembly including a valve configured to fluidly couple the outlet of the fluid controller to the inflatable device, the valve including a self-sealing diaphragm assembly configured to seal the outlet;

an electromechanical device configured to act on the self-sealing diaphragm assembly to open the valve;

a pump including a motor and an impeller located within the housing, the pump configured for moving air from the inlet through the air conduit to the outlet; and at least one vane positioned within the air conduit, wherein the inflatable device includes an inflatable bladder;

wherein a majority of the fluid controller is positioned within a profile of the inflatable bladder in a mounted position and orientation, and wherein in the same mounted position and orientation of the fluid controller, the fluid controller is configured to electromechanically open the valve via the electromechanical device to permit air to exit the inflatable bladder through the fluid controller and to energize the pump to provide air to the inflatable bladder through fluid controller.

9. The inflatable device of claim 8, wherein the vane has a sweep.

10. The inflatable device of claim 9, wherein the sweep of the vane is configured to gradually redirect fluid flowing through the air conduit from primarily rotational motion to primarily axial motion.

11. The inflatable device of claim 8, wherein the pump is externally accessible when the fluid controller is disposed in the mounted position and orientation.

12. The inflatable device of claim 8, wherein the pump is detachably connected within the fluid controller.

13. The inflatable device of claim 8, wherein the at least one vane extends at least 90% of the length of the fluid conduit.

14. The inflatable device of claim 8, wherein the at least one vane includes a plurality of vanes that each extend unbroken for substantially all of their length.

15. The inflatable device of claim 8, wherein at least a portion of the valve assembly is permanently coupled to the outlet of the housing of the fluid controller.

16. The inflatable device of claim 8, wherein the valve is a self-sealing valve.

17. The inflatable device of claim 8, wherein the housing is coupled to a socket within a profile of the inflatable bladder, and wherein in the mounted position and orientation of the fluid controller, the majority of the pump and the valve assembly are located in the socket.

18. The inflatable device of claim 17, wherein the socket includes a wall, and wherein the valve assembly is disposed in an area defined by the wall.

19. The inflatable device of claim 8, the fluid controller further comprising a first switch electrically connected to the pump and configured to energize the pump, and a second switch configured to operate the electromechanical device mechanism.

20. The inflatable device of claim 8, wherein the electromechanical device includes a solenoid.

* * * * *